US005579926A

United States Patent [19]

Markarian

[11] Patent Number: 5,579,926

[45] Date of Patent: Dec. 3, 1996

[54] COOKBOOK HANGER

[76] Inventor: Jean Markarian, 2416 Baggett Dr., Santa Rosa, Calif. 95401

[21] Appl. No.: 377,981

[22] Filed: Jan. 25, 1995

[51] Int. Cl.[6] ..... A47F 7/00

[52] U.S. Cl. ..... 211/42; 248/444.1

[58] Field of Search ..... 211/42, 113, 45; 248/309.1, 444.1, 441.1, 459; 232/1 C

[56] References Cited

U.S. PATENT DOCUMENTS

| | | | |
|---|---|---|---|
| 3,174,626 | 3/1965 | West . | |
| 3,809,352 | 5/1974 | Mathias | 248/444.1 |
| 4,200,945 | 5/1980 | Ellis | 11/1 ET |
| 4,369,948 | 1/1983 | Krauss et al. | 248/444.1 |
| 4,418,825 | 12/1983 | Mahowald | 211/42 |
| 4,856,660 | 8/1989 | Selwyn-Smith | 211/46 |
| 4,901,912 | 2/1990 | Pinard | 232/1 C |
| 4,993,680 | 2/1991 | Gemmen et al. | 248/444.1 |
| 5,000,380 | 3/1991 | Barrios | 232/1 CX |
| 5,458,312 | 10/1995 | Goldberg | 248/444.1 |

*Primary Examiner*—Robert W. Gibson, Jr.

[57] ABSTRACT

A cookbook hanger includes spaced apart, transparent vertical walls connected by a bottom member. Each wall includes a hook integrally extending from a top edge thereof. An open cookbook is receivable between the walls, and the hanger is hangable on a doorknob or handle of a kitchen cabinet. Thus the hanger supports the cookbook at eye level for convenient reference during cooking. It frees up counter space, and it keeps the cookbook clean by positioning it away from a messy countertop.

3 Claims, 1 Drawing Sheet

COOKBOOK HANGER

BACKGROUND OF THE INVENTION

1. Field of the Invention

This invention relates generally to kitchen accessories, specifically to a hanger for hanging a cookbook on a cabinet to free up counter space.

2. Prior Art

Cookbooks are commonly used for reference during the cooking process. However, an open cookbook placed on a countertop not only reduces valuable space, it can easily get wet or covered with food. Furthermore, a cookbook placed on a countertop, which is at waist level, is too far away to be easily read.

A document hanger disclosed in U.S. Pat. No. 4,856,660 to Selwyn-Smith (1989) includes a flexible transparent sleeve for receiving a document, and a rail attached to a top edge thereof for hanging on a rod in a filing cabinet. The rail has a hook-shaped cross section that curves towards the rear of the hanger. Although it can receive and display an open cookbook, most kitchens do not have rods for hanging it. The sleeve is closed along its top and bottom edges, so that it cannot receive a book taller than itself. Although the rail can be hung on the door knob of a kitchen cabinet, it will easily slide off if it is not perfectly balanced. U.S. Pat. Nos. 3, 174,626 to West (1965); 4,220,945 to Ellis (1980); and 4,418,825 to Mahowald (1983) all show book hangers, but these are only useful for hanging books in a closed condition.

OBJECTS AND ADVANTAGES

Accordingly the primary objects and advantages of the present invention are to provide an improved book hanger, a book hanger which can hold and display a cookbook in an open condition for reference during cooking, which supports a cookbook off a countertop to free up valuable space, which supports a cookbook off a messy countertop to keep it clean, which supports a cookbook at eye level for convenient reading, which can stably support a cookbook on commonly available structures in a kitchen, and which is very simple to manufacture. Other objects and advantages will become apparent from a study of the following description of the invention.

SUMMARY OF THE INVENTION

A cookbook hanger includes a pair of spaced, transparent opposite walls connected by a bottom member for receiving an open cookbook therein. Each wall includes a hook extending from a top edge thereof for hanging onto a knob or handle of a kitchen cabinet door, so that the cookbook can be displayed at eye level in an open condition, and so that it does not consume valuable counter space.

BRIEF DESCRIPTION OF THE DRAWING FIGURES

Drawing Reference Numerals

10. Cookbook Hanger
11. Walls
12. Bottom Member
13. Hooks
14. Doorknob
15. Kitchen Cabinet
16. Cookbook
17. Kitchen Cabinet
18. Door Handle

DETAILED DESCRIPTION OF THE DRAWINGS

Figure 1:
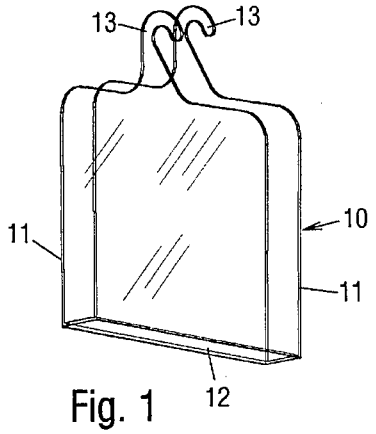
FIG. 1 is a front perspective view of a cookbook hanger in accordance with a preferred embodiment of the invention.

In accordance with a preferred embodiment of the invention shown in the front perspective view in FIG. 1, a cookbook hanger 10 includes a pair of spaced walls 11 connected along their lower edges by a bottom member 12. A flat hook 13 extends integrally from a top edge of each wall 11. Each hook 13 is on the same plane as a corresponding wall 11. The entire hanger is made of a substantially rigid, but slightly flexible, transparent plastic, such as acrylic. It is formed as one homogeneous sheet by either being molded as a single part, or by being cut from a flat sheet of acrylic and heat formed into a U-shape.

Figure 2:
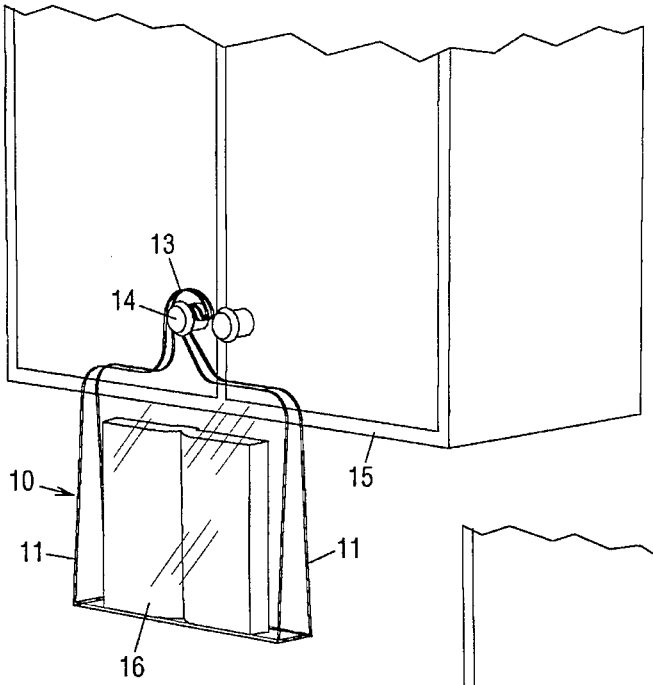
FIG. 2 is a front perspective view of the cookbook hanger supported on a doorknob of a kitchen cabinet.
Figure 3:
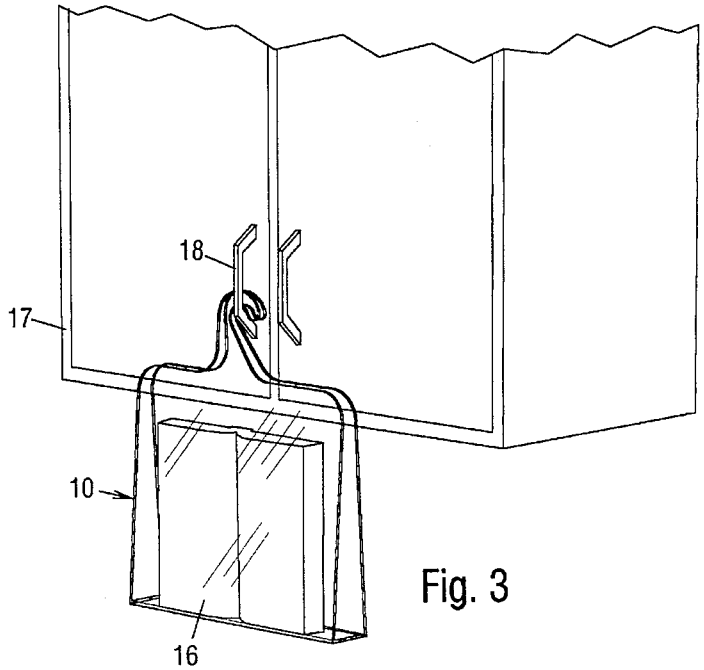
FIG. 3 is a front perspective view of the cookbook hanger supported on a door handle of a kitchen cabinet.

In use, cookbook hanger 10 is hung on a supporting member or doorknob 14 of a kitchen cabinet 15, as shown in FIG. 2. Walls 11 are bend together so that both hooks 13 are supported on doorknob 14. An open cookbook 16 is received in hanger 10. Thus cookbook 16 is kept in an open condition at eye level, so that it can be easily read through transparent wall 11. Hanger 10 frees up valuable counter space, and keelis cookbook 16 clean by holding it away from a messy countertop (not shown). If a cabinet 17 is provided with handles 18 instead, as shown in FIG. 3, hanger 10 can also be hung thereon. Whether hanger 10 is supported on doorknob 14 or handle 18, it would be stably supported, and will not easy fall off.

CONCLUSION, RAMIFICATIONS, AND SCOPE

Accordingly the reader will see that I have provided an improved cookbook hanger. It can receive and display an open cookbook. It supports an open cookbook at eye level for convenient reading during cooking. It frees up counter space. It keeps a cookbook clean by supporting it away from a messy countertop. It is also very easy to manufacture.

Although the above descriptions are specific, they should not be considered as limitations on the scope of the invention, but only as examples of the preferred embodiment. Many other ramifications and variations are possible within the teachings of the invention. For example, the hanger can be provided with just one hook. Only one wall needs to be transparent. The hook may be a bent rod, but such a hook would still be substantially flat. The walls and the bottom can be made or cut as separate pieces and cemented together. In addition to cookbooks, the hanger can be used for holding other types of books or documents. Therefore, the scope of the invention should not be determined by the examples given, but by the appended claims and their legal equivalents.

I claim:

1. A book hanger, comprising:

a pair of spaced apart, transparent vertical walls connected along bottom edges thereof and adapted to receive an open book therebetween; and a pair of hooks each connected to and coplanar with a corresponding wall, said hooks being adapted to be hung on a supporting member.

2. A book hanger, comprising:

a pair of spaced apart, transparent walls adapted to receive an open book therebetween;

a bottom member connecting said walls along bottom edges thereof; and a pair of hooks each connected to and coplanar with a corresponding wall, said hooks being adapted to be hung on a supporting member.

3. A book hanger, comprising:

a pair of spaced apart and substantially rigid, transparent vertical walls adapted to receive an open book therebetween, said walls being connected only along bottom edges thereof by a bottom member; and a pair of flat hooks integrally extending from a top edge of and coplanar with a corresponding wall, said hooks being adapted to be hung on a supporting member.

* * * * *